United States Patent [19]

Breuer et al.

[11] 4,130,417

[45] Dec. 19, 1978

[54] PROCESS FOR REFINING HIGH-CARBON FERRO-ALLOYS

[75] Inventors: Friedrich Breuer, Eschweiler; Günter Duderstadt, Ratingen; Werner Dresler, Bardenberg; Rudolf Fichte, Nüremberg; Peter Kunert, Oberasbach; Gerd Nassauer, Inden, all of Germany

[73] Assignee: GfE Gesellschaft für Elektrometallurgie mit beschränkter Haftung, Düsseldorf, Germany

[21] Appl. No.: 850,003

[22] Filed: Nov. 9, 1977

Related U.S. Application Data

[63] Continuation of Ser. No. 704,098, Jul. 9, 1976, abandoned.

[30] Foreign Application Priority Data

Jul. 11, 1975 [DE] Fed. Rep. of Germany ..... 2531034
Sep. 10, 1975 [DE] Fed. Rep. of Germany ..... 2540290

[51] Int. Cl.[2] ..... C21C 5/34; C21C 7/06

[52] U.S. Cl. ..... 75/60; 75/51; 75/52

[58] Field of Search ..... 75/51, 52, 60

[56] References Cited

U.S. PATENT DOCUMENTS 3,909,245 9/1975 Brotzmann ..... 75/60

3,955,965 5/1976 Putzier ..... 75/52

*Primary Examiner*—P. D. Rosenberg
*Attorney, Agent, or Firm*—Karl F. Ross

[57] ABSTRACT

A hign-carbon ferro-alloy, specifically ferrochrome or ferromanganese, is decarburized in a converter in which oxygen or air is blown from below into the melt together with a surrounding protective gas. With the bath preheated to a temperature somewhat higher than the melting point of the ferro-alloy, the oxygen is introduced at such a rate that its reaction with the chromium or the manganese locally superheats the bath, in a region well below the surface and spaced from the converter walls, to a temperature high enough to let the resulting oxides react endothermically with the carbon. This reaction takes place in combustion zones believed to be localized in gas bubbles formed above the injection nozzles, the oxidation of the ferrous and nonferrous constitutents occurring at the interface between the gas and the melt with formation of a very thin and highly reactive oxide skin around each bubble. Some high-melting oxides of chromium or manganese may remain after the oxygen blow but can be reduced by blowing in powdered lime, after and possibly also with the oxygen, and by the deposition of solid or liquid reducing agents on the bath surface. A minor fraction of the ferro-alloy may be added in solid form to hold down the bath temperature.

15 Claims, 1 Drawing Figure

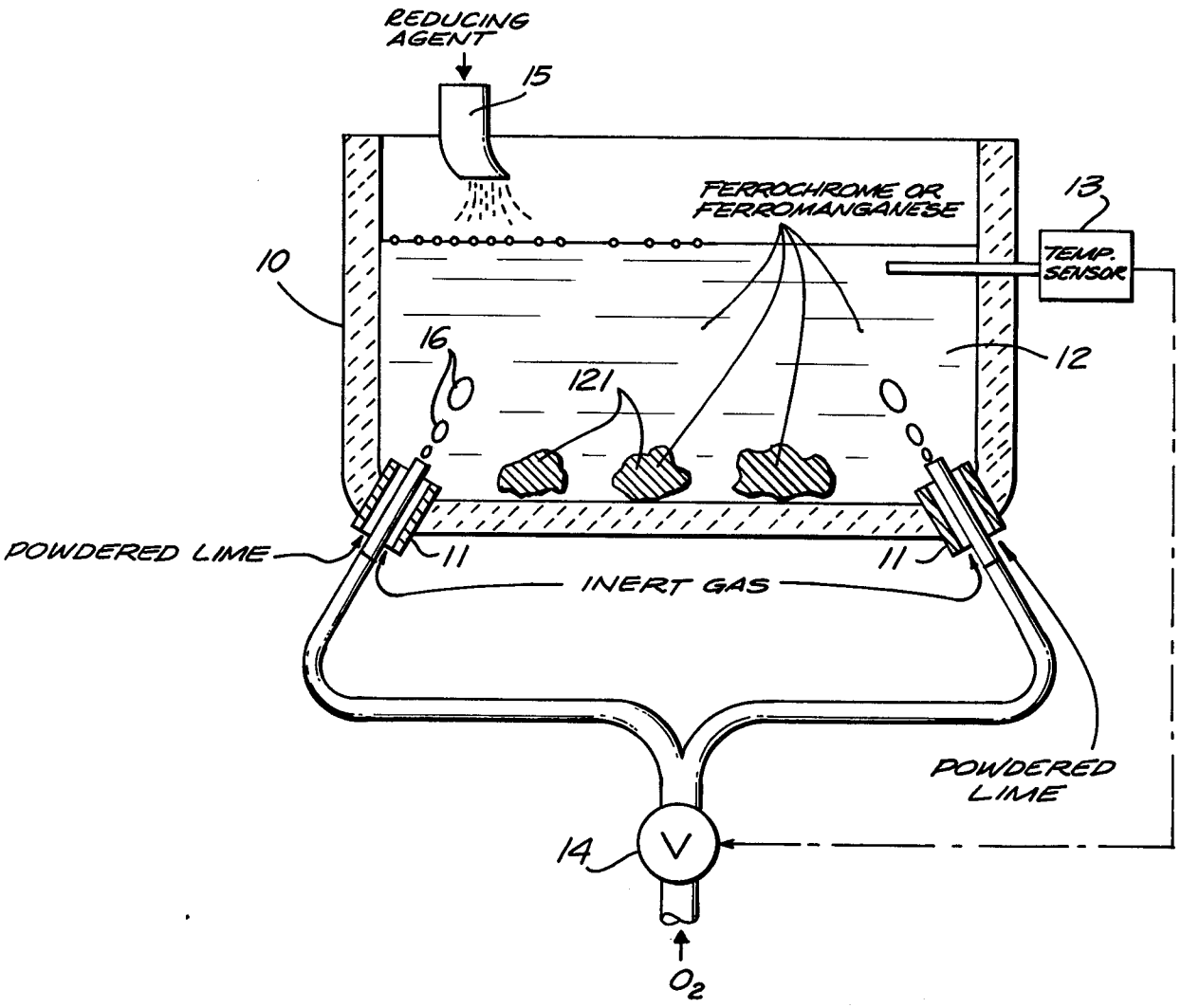
REDUCING AGENT
15
FERROCHROME OR FERROMANGANESE
TEMP. SENSOR
13
12
121
16
10
11
11
INERT GAS
POWDERED LIME
POWDERED LIME
14
$O_2$

PROCESS FOR REFINING HIGH-CARBON FERRO-ALLOYS

This is a continuation of application Ser. No. 704,098, filed July 9, 1976, now abandoned.

FIELD OF THE INVENTION

Our present invention relates to a process for refining high-carbon ferro-alloys, especially ferrochrome or ferromanganese, in a converter into which oxygen (pure or as part of an airstream) is introduced through jacketed nozzles together with a surrounding flow of a protective gas.

BACKGROUND OF THE INVENTION

In U.S. Pat. No. 3,751,242 there has been described a process for making chromium alloys, specifically ferritechromium steel, by refining a pig-iron melt in a converter and then admixing therewith a ferrochrome of high carbon content whereupon the mixture is subjected to another oxygen blow in order to reduce the carbon content of the resulting alloy.

In commonly owned U.S. patent application Ser. No. 527,826, filed by some of us jointly with several others on Nov. 27, 1974, there has been disclosed a process for the rapid decarburization of ferro-alloys — specifically ferrochrome and ferromanganese — which are not admixed with a prerefined, larger mass of pig iron, that process enabling the lowering of the carbon content of the ferro-alloy at a rate of substantially 0.2% to 1% per minute. Essentially, the process of that commonly owned application involves the use of an oxygen-blowing rate of about 15 cubic meters S.T.P. per minute for each metric ton of ferro-alloy, the minimum rate being thus 3 $m^3$/min per ton for a decarburization rate of 0.2% C per minute. The amount of 15 $m^3$ S.T.P. per ton-percent may be regarded as a quasi-stoichiometric equivalent.

It has been determined that, with observation of those parameters, the reactions otherwise occurring in the supernatant slag take place directly in the melt, with little formation of chromium or manganese oxides from which these nonferrous metals can be recovered only in laborious ways and at high cost. Still, the rapid decarburization described in that prior application — with removal of 1% carbon in not more than 5 minutes — requires a rather precise control of the oxygen feed. This creates some technical problems, especially since the relatively short reaction time makes it difficult to readjust the feed rate during the blow on the basis of readily observable parameters. Another problem encountered, especially with large quantities of ferro-alloy to be refined, is the danger of a rise in the bath temperature above levels that can be safely tolerated by commercially available converters.

OBJECTS OF THE INVENTION

The general object of our present invention is to provide certain criteria for enhancing the versatility of a refining process of the general type described in the above-identified prior application.

A more particular object is to provide a simple and efficient way of controlling such a refining process.

SUMMARY OF THE INVENTION

These objects are realized, in accordance with our present invention, by training jets of oxygen and protective gas upon a region within the melt which is spaced from the boundaries of the bath and located below its surface, the oxygen being blown in at a rate sufficient to cause local superheating of the melt in that region to a reaction temperature at which some of the carbon present in the melt is oxidized by contact with the products of interaction of the oxygen with the constituents of the ferro-alloy. On the basis of a determination of the overall bath temperature, the flow of oxygen is controlled to prevent a rise in that temperature above a predetermined limit.

The bath is initially heated to a temperature which lies only moderately above the melting point of the ferro-alloy, exceeding that melting point by preferably not less than 100° C. but lying well below an optimum reaction temperature at which the carbon present in the melt reduces the oxides of its metallic constituents so as to leave only a minimum amount of slag. Within the active region, thus at locations remote from the converter walls, the oxygen interacts exothermally with these metallic constituents so as to cause the aforementioned local rise in temperature; the overall bath temperature, however, increases more slowly and can therefore be held within acceptable limits despite the intense heat in the reaction zone. In the case of ferrochrome and ferromanganese, the localized reaction temperature can easily attain values above an upper limit of substantially 2000° C. set for the overall bath temperature whose final level, in accordance with our present invention, should lie between that upper limit and a lower limit of substantially 1650° C. More particularly, the final range of the overall bath temperature should be about 1650° to 1900° C. in the case of ferromanganese and about 1750° to 2000° C. in the case of ferrochrome. The initial bath temperature should range between substantially 1200° and 1600° C., being generally lower for ferromanganese (melting point 1060° – 1220° C.) than for ferrochrome (melting point 1360° to 1400° C.).

We have found that, under these conditions, the decarburization process essentially takes place in combustion zones that apparently are localized in gas bubbles formed, in the case of a bottom-blown converter, at a certain distance above the injection nozzles which depends upon the injection velocity. Thus, if the bath surface lies about 25 to 80 cm above the nozzle mouths, the velocity of the air or oxygen jet at these mouths should lie between approximately 100 and 1000 meters per second with the nozzle axes oriented vertically or nearly vertically, i.e. at an angle of inclination to the vertical not greater than about 25°. In these gas bubbles, which may combine into chains or elongated voids, not only the temperatures but also the pressures are higher than elsewhere in the bath; thus, the atmospheric and hydrostatic pressures normally present are supplemented by the surface tensions at the interfaces between the gas and the melt. It is at these interfaces that the ferrous and nonferrous components off the melt are oxidized in what may be an extremely thin layer, e.g. of monomolecular thickness, the oxides being thus in a highly reactive state conducive to an endothermic oxidation of the available carbon. That reaction may be expressed by the formulas $$2(Cr_2O_3)/3 + 2C = 4Cr/3 + 2CO \quad (1)$$

in the case of ferrochrome and $$2(Mn_2O)/3 + 2C = 4Mn/3 + 2CO \quad (2)$$

in the case of ferromanganese.

In order to hold down the overall bath temperature without detrimentally affecting the reactions in the combustion zones, we prefer to introduce a minor fraction of the ferro-alloy into the converter in solid form, either before filling the converter with the melt or thereafter, possibly in stages continuing during the oxygen blow. This solid fraction, which preferably has the same composition as the melted ferro-alloy, may be present in an amount of up to 20% (by weight) of the total ferro-alloy, i.e. of the sum of its melted and solid fractions; a preferred proportion is about 12%.

We have further found, in accordance with our present invention, that the reaction will proceed most satisfactorily if the oxygen is blown in at a rate which may vary between substantially 10 and 30 cubic meters S.T.P. within a unit period t ranging between substantially 0.1 and 2 minutes, the duration T = pqt of the blow being then determined by multiplying this unit period t by the number p of weight-percent of carbon to be removed from the bath and by the total quantity q of ferro-alloy in metric tons. Advantageously, the blowing rate is so chosen as to remove 1 weight-percent carbon from the bath in a time of 1 to 15 minutes. It will be noted that these criteria substantially extend the possible blowing time beyond the maximum of 5 minutes per %C given in the prior application.

Thanks to the high reaction temperature prevailing in the combustion zones, only small quantities of high-melting chromium or manganese oxides will remain at the end of the blow. These residual oxides of the nonferrous components may be removed, pursuant to still another feature of our invention, by blowing powdered lime into the melt upon termination of the oxygen blow and depositing a reducing agent on the bath in either solid or liquid form. The lime, some of which could also be introduced during the oxygen blow (as known per se from U.S. Pat. No. 3,751,242) for smoother and more rapid gas evolution from the melt, helps maintain the reactivity of these oxides as they float to the surface and react there with the reducing agents. Aside from these residual oxides, any slag formed during the refining operation may contain some elemental chromium or manganese which can be easily recovered by melting.

An inert gas such as argon, or possibly nitrogen in the case of ferromanganese, may be used as a carrier of the lime after the oxygen blow. During that blow, especially if no lime is to be injected, hydrocarbons such as natural gas or propane can be used as the protective gas. Suitable reducing agents, introduced into the converter from above, include silicon, ferrosilicon, ferroaluminum, pure aluminum, silicochrome and silicomanganese. The deposition of the reducing agent on the bath surface occurs preferably immediately after the termination of the oxygen blow, simultaneously with the injection of the powdered lime.

BRIEF DESCRIPTION OF THE DRAWING

Our invention will now be described in greater detail with reference to the accompanying drawing the sole FIGURE of which shows, diagrammatically, a converter in which the present refining process is carried out.

SPECIFIC DESCRIPTION

A bottom-blown converter 10 is provided with a number of jacketed nozzles 11 whose axes are inclined to the vertical at an angle of about 15° and whose mouths lie between 25 cm and 80 cm below the surface of a bath 12 of molten metal. A thermometer 13, such as a thermoelectric sensor, measures the overall bath temperature and generates a signal which controls, via a valve 14, the admission of oxygen (or air) to the nozzles 11 at a rate ranging between 100 and 1000 m/sec. The resulting oxygen or air stream is surrounded by a flow of protective gas which passes through the nozzle jackets. A distributor 15 serves for the deposition of a reducing agent on the bath surface at the end of the oxygen blow. Converter 10 is lined with magnesium in the usual manner.

The bath 12 consists, essentially, of ferrochrome or ferromanganese in the liquid state; a minor fraction of this material is also present in solid form, as indicated at 12'. The entering gas jets form bubbles 16 whose surface tension, depending on their diameter, superimposes itself upon the hydrostatic pressure of the melt and the overlying atmospheric pressure in creating reaction-promoting conditions, different from those in the remainder of the bath, within these voids. With the oxygen entering at a mean rate as specified above, the carbon content of the melt is lowered by 1% in a period of one to fifteen minutes as the metallic constituents of the melt are initially oxidized along the walls of bubbles 16 and then react with the carbon, presumably in conformity with equation (1) or (2) as far as the nonferrous metals are concerned. If the melt is rich in silicon, the oxygen flow should be closer to the upper limit of the range of 10 to 30 $m^3$ S.T.P. per unit period t (of 0.1 to 2 minutes); if desired, the process may be carried out in two phases, with a higher blowing rate in the first phase and a lower blowing rate in the second phase after removal of the resulting silicon slag.

Powdered lime is introduced through the nozzle jackets after (and possibly also during) the oxygen blow; the resulting slag coacts with the reducing agent deposited on the bath in liquid or granular form with the aid of distributor 15. Upon completion of the refining process, the decarburized melt can be poured from the converter into a ladle and thence into a casting mold.

EXAMPLE I

A high-carbon ferromanganese is to be refined to a carbon content of not more than 1%. The initial composition of this alloy, by weight, is:

76.8% Mn
6.3% C
0.61% Si
0.18% P
0.04% S
balance Fe.

4840 kg of this material in liquid form, at a temperature of 1370° C., is introduced into the converter together with 500 kg thereof in solid form, the latter having an initial temperature of up to 600° C. Oxygen, enveloped by a flow of natural gas passing through the nozzle jackets, is blown in at a mean rate of 16 $m^3$ S.T.P. per minute for a time T of 27.88 minutes, with the overall bath temperature rising to 1840° C. at the end of the blow. Thereafter, for an interval of 3.78 minutes, argon is introduced through the nozzle jackets at a rate of 14 $m^3$ S.T.P. per minute together with 240 kg of powdered lime. During the same interval, 428 kg of silicomanganese is deposited on the bath surface. The result is 5020 kg of refined ferromanganese of the following composition:

81.0% Mn
0.96% C
0.61% Si
0.18% P
0.02% S
balance Fe.

The recovery of manganese is 91.8%.

In this Example, with a quantity q of 5.34 metric tons of ferro-alloy processed and with a reduction of the carbon content by p = 5.3%, the removal of 1% C takes place in approximately 5¼ minutes. Thus, in a unit period t = T/pq equaling slightly less than a minute a quasi-stoichiometric amount of about 15 $m^3$ S.T.P. of oxygen per ton-percent is blown in.

EXAMPLE II

A high-carbon ferrochrome is to be refined, again to a maximum carbon content of 1%. The initial composition of this alloy, by weight, is:

66.4% Cr
5.1% C
0.71% Si
0.10% S
0.04% P
balance Fe.

8540 kg of this material in liquid form, at a temperature of 1520° C., is introduced into the converter together with 1100 kg thereof in solid form, the latter having an initial temperature of up to 1000° C. Oxygen, with propane as a protective fluid, is blown in at a mean rate of 25 $m^3$ S.T.P. per minute for a time T of 25.44 minutes; during the blow, the overall bath temperature rises to 1920° C. Thereafter, for 3 minutes, argon is introduced at a rate of 15 $m^3$ S.T.P. per minute together with 627 kg of powdered lime while 386 kg of silicochrome is deposited on the bath surface. The result is 9050 kg of refined ferrochrome of the following composition:

69.7% Cr
0.91% C
0.40% Si
0.03% S
0.02% P
balance Fe.

The recovery of chromium is 96.1%.

Here, with $p = 4.2\%$, the removal of 1% C is accomplished in about 6 minutes. With q = 9.64 metric tons, a unit period t = T/pq equals substantially 0.6 minute, again corresponding to a quasi-stoichiometric amount of 15 $m^3$ S.T.P. of oxygen per ton-percent.

We claim:

1. A process for refining a high-carbon ferro-alloy, comprising the steps of:

preparing a bath of melted high-carbon ferro-alloy to be refined, said ferro-alloy being selected from the group which consists of ferrochrome and ferromanganese;

preheating said bath to an overall temperature higher than the melting point of said ferro-alloy;

blowing oxygen together with an enveloping protective gas into the preheated bath, in jets trained upon a region spaced from the boundaries of the bath and located below the surface thereof, at a rate sufficient to cause local superheating of the melt, due to interaction of the oxygen with the ferro-alloy, in said region to a reaction temperature higher than said overall temperature at which carbon contained in the melt is oxidized by contact with the products of said interaction;

determining changes in said overall temperature; and controlling the flow of oxygen to prevent a rise of said overall temperature above a predetermined limit.

2. A process as defined in claim 1 wherein the flow of oxygen is controlled to raise said overall temperature from an initial level lying between substantially 1200° and 1600° C. to a final level lying between substantially 1650° and 2000° C.

3. A process as defined in claim 2, wherein the oxygen is blown in at a rate of substantially 10 to 30 cubic meters S.T.P. within a unit period t, said unit period ranging between substantially 0.1 and 2 minutes, the duration of the blow being pqt wherein p is the number of weight-percent of carbon to be removed from the bath and q is the total quantity of ferro-alloy in metric tons.

4. A process as defined in claim 2 wherein said component is manganese, said final level being established at not more than 1900° C.

5. A process as defined in claim 2 wherein said component is chromium, said final level being established at not less than 1750° C.

6. A process as defined in claim 2, comprising the further step of blowing powdered lime into said region upon termination of the oxygen blow for reacting with high-melting oxides of said component.

7. A process as defined in claim 6, comprising the further step of depositing a reducing agent on said bath simultaneously with the introduction of said lime.

8. A process as defined in claim 1, comprising the further step of introducing a minor fraction of said ferro-alloy in a solid state into said bath.

9. A process as defined in claim 8 wherein said minor fraction has substantially the same composition as the melted ferro-alloy.

10. A process as defined in claim 8 wherein the amount of said minor fraction ranges up to about 20%, by weight, of the total quantity of said ferro-alloy.

11. A process as defined in claim 1 wherein the oxygen is blown in at a rate sufficient to remove 1 weight-percent carbon from the bath in a time of 1 to 15 minutes.

12. A process as defined in claim 1 wherein said jets are introduced into the melt, at a level lying about 25 to 80 cm below the bath surface, with a velocity ranging between substantially 100 and 1000 meters per second.

13. A process for refining a high-carbon ferro-alloy selected from the group which consists of ferrochrome and ferromanganese, comprising the steps of:

preparing a bath of melted high-carbon ferro-alloy to be refined;

preheating said bath to an initial temperature higher than the melting point of said ferro-alloy, said initial temperature lying between substantially 1200° and 1600° C.;

blowing oxygen together with an enveloping protective gas into the preheated bath for a time sufficient to cause the removal of a significant proportion of carbon from said ferro-alloy, at a rate controlled to raise the bath temperature to a final level lying between substantially 1650° and 2000° C.;

blowing powdered lime into the melt upon termination of the oxygen blow for reacting with higher-melting oxides of said nonferrous component; and depositing a reducing agent on said bath.

14. A process as defined in claim 13 wherein the ferro-alloy is ferromanganese, said final level being established at not more than 1900° C.

15. A process as defined in claim 13 wherein the ferro-alloy is ferrochrome, said final level being established at not less than 1750° C.

* * * * *